US005314062A

United States Patent [19]

Wu et al.

[11] Patent Number: 5,314,062

[45] Date of Patent: May 24, 1994

[54] INNERFRAME AND APPARATUS FOR PRODUCING AN IMPROVED INNERFRAME

[75] Inventors: Tsun-Chuan Wu, Surabaya, Indonesia; Liem T. Pao, Singapore, Singapore; Foo-Kong Wong, Surabaya, Indonesia

[73] Assignee: P.T.H.M. Sampoerna, India

[21] Appl. No.: 641,694

[22] Filed: Jan. 16, 1991

[51] Int. Cl.[5] ..... B65D 85/10

[52] U.S. Cl. ..... 206/268; 206/273; 229/160.1

[58] Field of Search ..... 206/268, 271, 273; 229/160.1

[56] References Cited

U.S. PATENT DOCUMENTS

| | | | |
|---|---|---|---|
| 4,216,898 | 8/1980 | Davies | 206/273 |
| 4,729,508 | 3/1988 | Erdmann | 206/273 |
| 4,732,315 | 3/1988 | Gunn | 229/DIG. 4 |
| 4,753,384 | 6/1988 | Focke et al. | 206/271 |

FOREIGN PATENT DOCUMENTS

| | | | |
|---|---|---|---|
| 0626784 | 10/1961 | Italy | 229/160.1 |
| 0266708 | 5/1927 | United Kingdom . | |
| 0332713 | 7/1930 | United Kingdom . | |
| 0522469 | 6/1940 | United Kingdom | 229/160.1 |
| 2011353 | 7/1979 | United Kingdom | 206/273 |

*Primary Examiner*—Jimmy G. Foster

*Attorney, Agent, or Firm*—Fliesler, Dubb, Meyer & Lovejoy

[57] ABSTRACT

A frame for securely retaining a bundle of elongated members, as for example cigarettes, within a container is provided. The container includes a bottom box panel, a top lid box panel, opposing right and left side box panels, and opposing front and back box panels. The frame is inserted into the container and comprises: a front frame panel portion defined by a left side and a right side, and a top and bottom margin; a left side frame panel connected to the front panel along the left side of said front panel, said left side panel including a left side biasing portion formed therein; and a right side frame panel connected to the front frame panel along the right side of said front panel, said right side panel including a right side biasing portion formed thereupon. The frame is erected and inserted into the box so that the front fame panel is contiguous with the front box panel, the left frame panel is contiguous with the left side box panel, and the right frame panel is contiguous with the right side box panel.

11 Claims, 9 Drawing Sheets

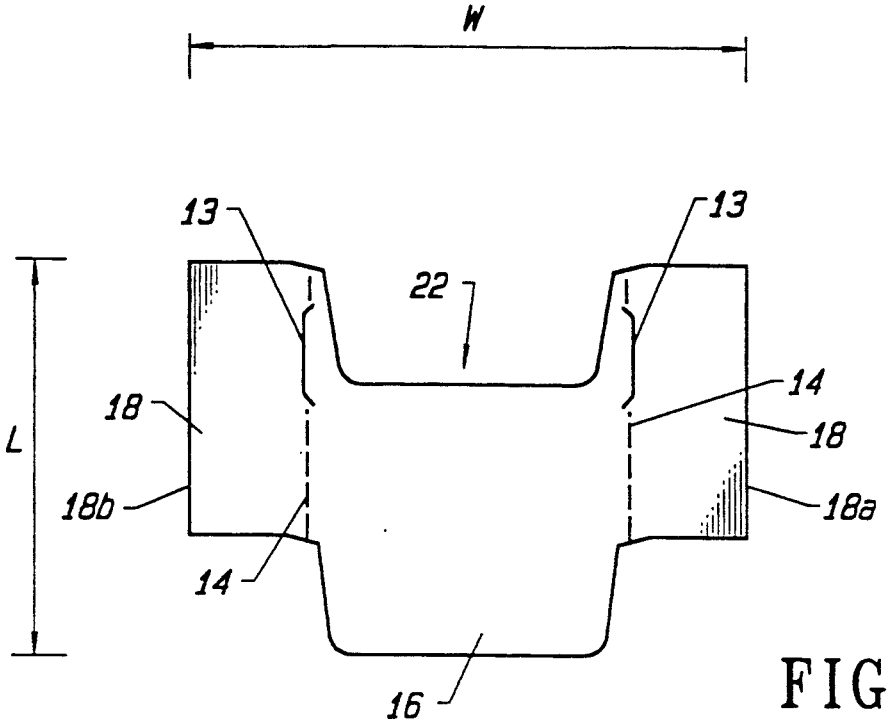
FIG. 2B
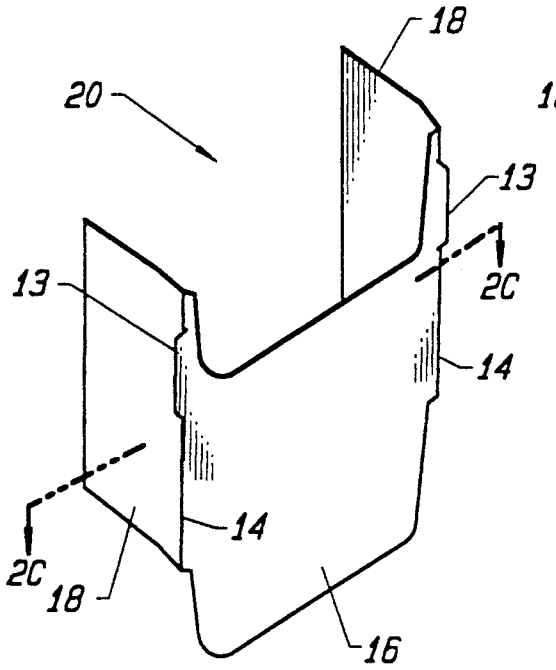
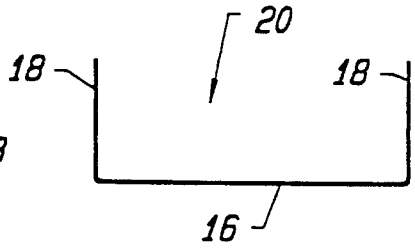
FIG. 2C
FIG. 2A

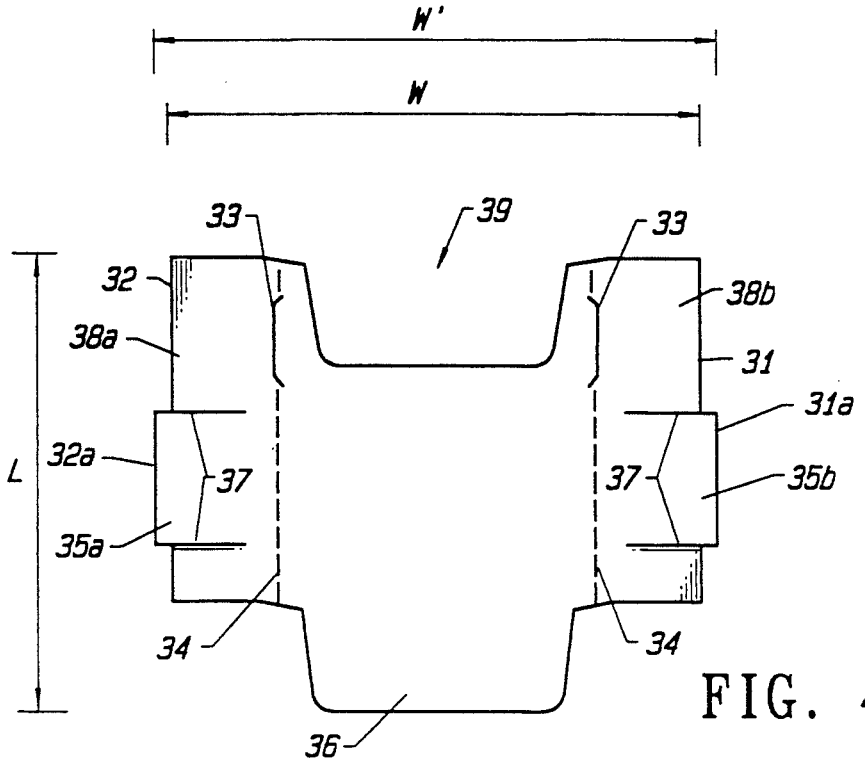
FIG. 4B
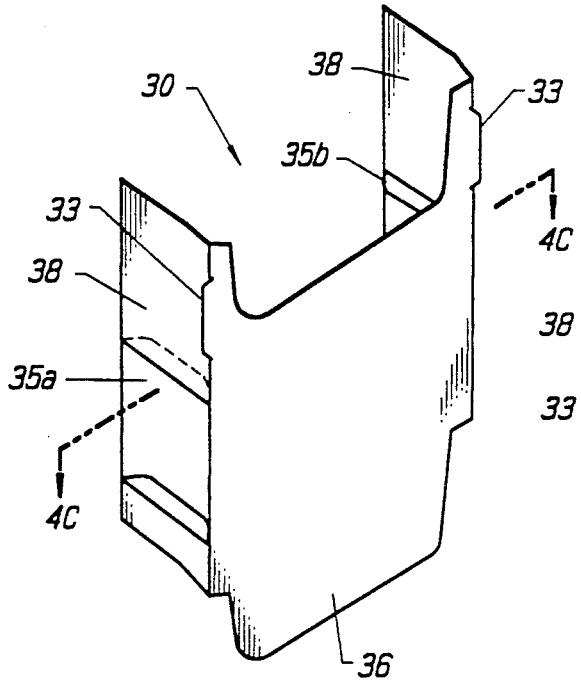
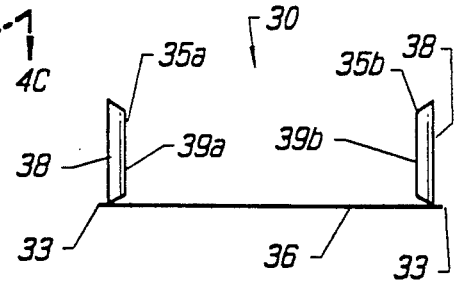
FIG. 4C
FIG. 4A

INNERFRAME AND APPARATUS FOR PRODUCING AN IMPROVED INNERFRAME

BACKGROUND OF THE INVENTION

1. Field of the Invention

The invention relates to an apparatus for securely packing cigarettes and other rod-like articles securely within a fixed size container.

2. Description of the Related Art

A typical cigarette package is usually designed to contain ten to twenty individual cigarettes in various packing configurations. Such a typical package is shown in FIG. 1 and includes an outer carton 10 having a conventional innerframe 20 surrounding, for example, ten individual cigarettes 15. Typically, cigarettes 15 are first wrapped in a foil package 12 on which conventional innerframe 20 is applied (See FIG. 3A), and foil package 12 with surrounding innerframe 20 is thereafter packaged in outer carton 10. A typical method for packaging cigarettes is disclosed in U.S. Pat. No. 3,956,865 issued to Schmermund.

Conventional innerframe 20 is shown specifically in FIGS. 2A–2C. An innerframe blank 22 is manufactured from a flat sheet of formable material, such as cardboard, by forming perforations 14 and tabs 13 through a cutting or stamping process. Perforations 14 and tabs 13 form a central region 16 and two side regions 18. As shown in FIG. 2A, innerframe blank 22 is folded along perforation lines 14 such that sides 18 are arranged to be perpendicular to the plane defined by central portion 16 to resemble the cross-section shown in FIG. 2C. Conventional innerframe 20 is now suitable for placement around foil wrapped cigarette bundle 12 as shown in FIGS. 3A and 3B. Innerframe 20 is typically wrapped around foil wrapped cigarette bundle 12 which surrounds, for example, ten cigarettes (FIG. 3A). Conventional innerframe 20 is then adhesively secured to the inside of outer carton 10 which is generally referred to as a "hinged lid pack" to provide the structure shown in FIGS. 1A–1C.

Cigarettes and other types of rod-like articles come in myriad lengths and diameters. Using conventional innerframe 20, separate individual sizes of innerframes and outer cartons would be required for as many different packaging schemes and sizes of cigarettes as are desired to be packaged. Such customization would require a plethora of machinery and increased production costs for each different cigarette type or packaging arrangement.

Further, conventional innerframe 20 provides only a minimum amount of additional buffering or retention force on individual cigarettes within the outer carton 10. Specifically, innerframe 20 provides support for the upper portion of those cigarettes once near the front of the outer carton lid opening the lid is open as shown in FIG. 1A, and generally cigarettes 15 are packed quite tightly within the outer carton 10 to prevent damage during shipment.

It is desireable to maintain standardized outer carton sizes to simplify manufacture of both the innerframe and the outer carton. It is further desireable to maintain constant carton sizes for a wide variety of cigarette sizes. Further, it is desireable for the innerframe to provide support for the cigarettes within the carton to avoid damage during shipping and loss of cigarettes upon first opening the outer carton.

SUMMARY OF THE INVENTION

The invention comprises a frame for securely retaining a bundle of elongated members, as for example cigarettes, within a container having a bottom box panel, a top lid box panel, opposing right and left side box panels, and opposing front and back box panels. The frame is inserted into the container and comprises: a front frame panel portion defined by a left side and a right side, and a top and bottom margin; a left side frame panel connected to the front panel along the left side of said front panel, said left side panel including a left side biasing portion formed therein; and a right side frame panel connected to the front frame panel along the right side of said front panel, said right side panel including a right side biasing portion formed thereupon. The frame is erected and inserted into the box so that the front fame panel is contiguous with the front box panel, the left frame panel is contiguous with the left side box panel, and the right frame panel is contiguous with the right side box panel.

BRIEF DESCRIPTION OF THE DRAWINGS

FIGS. 2A–2C are perspective and plan views of a conventional innerframe for use with the cigarette pack depicted in FIGS. 1A–1C.

FIGS. 4A–4C are perspective and plan views of the innerframe of the present invention.

DESCRIPTION OF THE PREFERRED EMBODIMENT

Figure 1C:
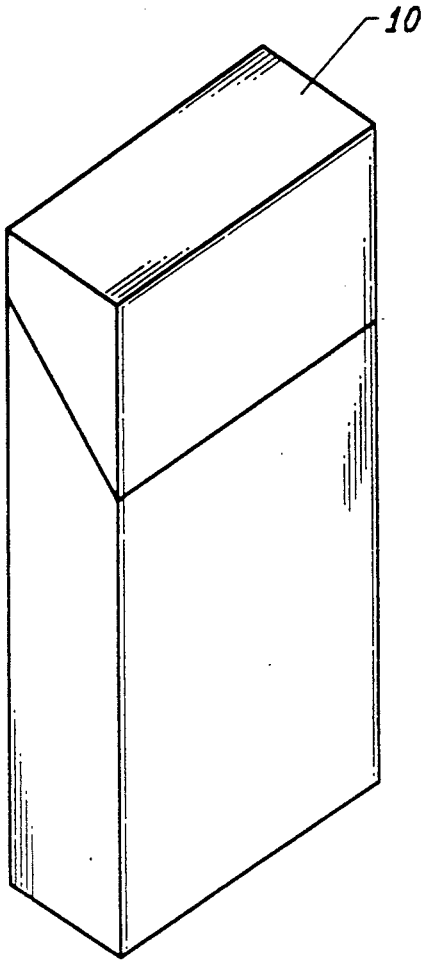
FIGS. 1A and 1C are perspective views of a bundle of cigarettes contained within an outer carton having an open lid and a closed lid, respectively.
Figure 1A:
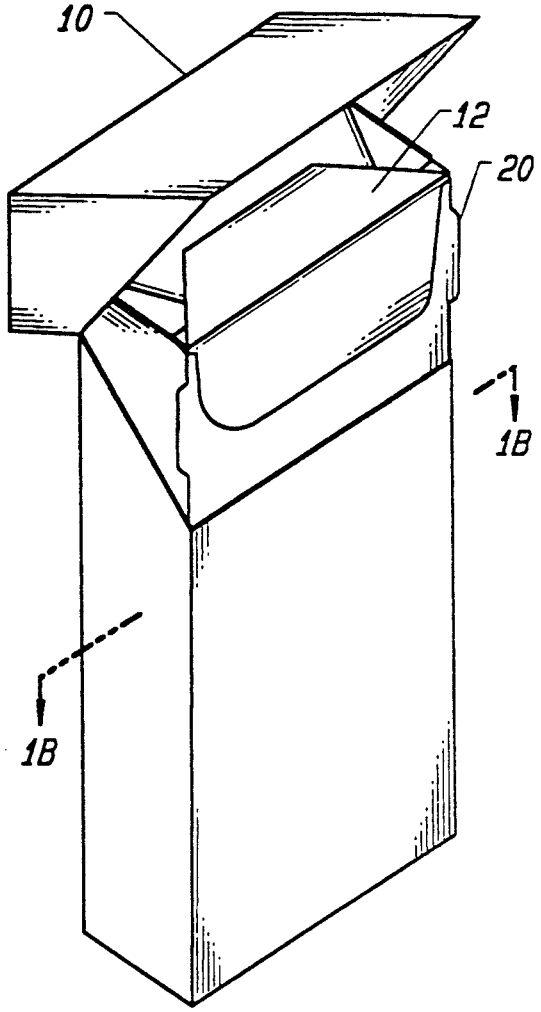
Figure 1B:
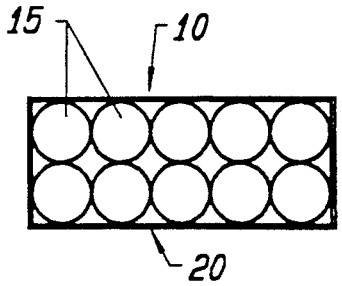
FIG. 1B is a top view of the bundle of cigarettes depicted in FIGS. 1A and 1C.
Figure 3A:
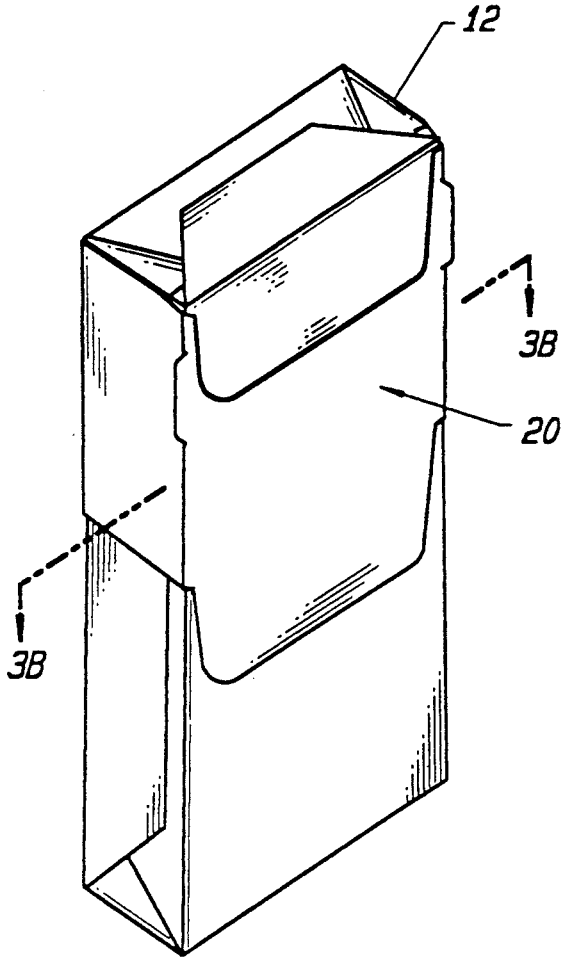
FIGS. 3A and 3B are perspective and plan views of the conventional innerframe depicted in FIGS. 2A–2C surrounding a foil bound bundle of cigarettes.
Figure 3B:
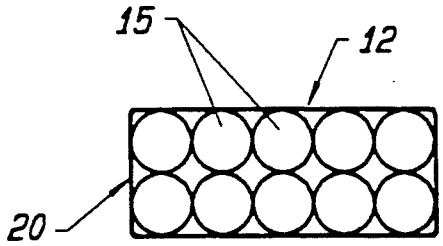

The present invention comprises an improved innerframe and apparatus for providing the improved innerframe. The innerframe of the present invention provides greater stability in packaging various sizes of cigarettes or other rod-like elements to be stored in a container. The present invention allows for various diameters of rod-like elements and various stacking arrangements of elements to be packaged within a single size container.

The innerframe of the present invention is shown in FIGS. 4A–4C. FIG. 4B depicts an innerframe blank 39 which is manufactured from a formable material, such as cardboard. It should be noted that any material which may be cut and formed as discussed herein is suitable for use in forming blank 39. Innerframe blank 39 has tabs 33 and perforations 34 formed therein which divide innerframe blank 39 into central region 36 and left and right side portions 38*a–b*. In addition, biasing tabs 35*a–b* are provided by horizontal cuts 37. As will be discussed below, biasing tabs 35*a–b* act to provide a tension force on cigarettes 15 to maintain cigarettes 15 within an outer carton or box. Preferably blank 39 is manufactured to have a length 1' greater than length 1 of conventional innerframe 20 to provide greater area for biasing tabs 35*a–b*. Biasing element 35*b* includes side 31*a* which extends beyond edge 31 of the innerframe blank 30. Likewise, biasing element 35*a* includes a side 32*a* which extends beyond edge 32 of the innerframe blank 30.

As shown in FIG. 4A, biasing elements 35*a–b* are each designed to have an arcuate shape toward the interior of innerframe 30 to provide the necessary biasing force.

Figure 5A:
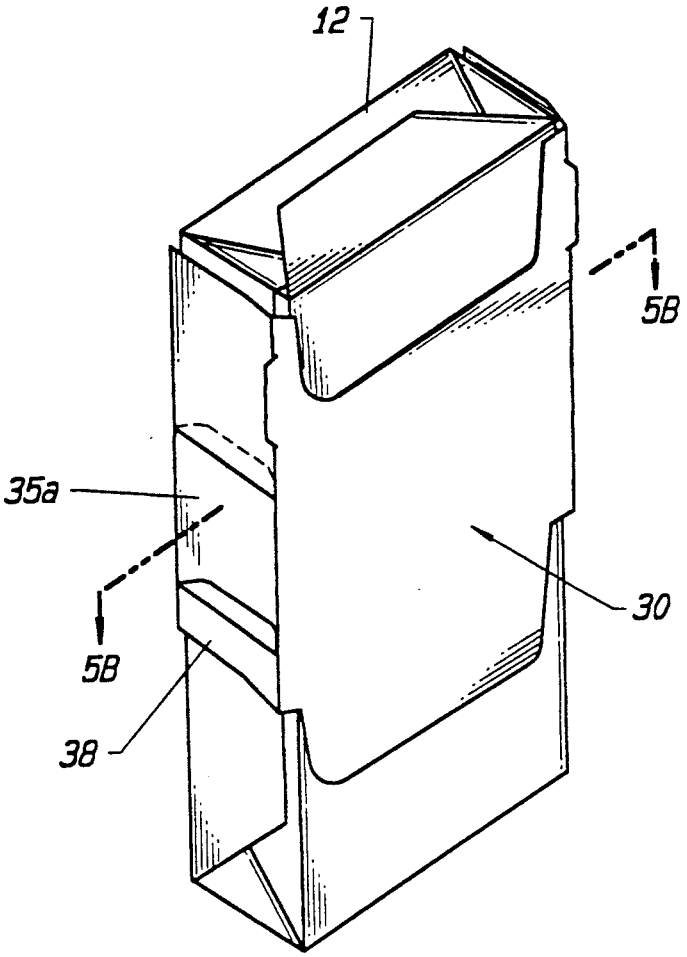
FIGS. 5A and 5B are perspective and plan views of the innerframe of the present invention surrounding foil bound bundle of cigarettes.
Figure 5B:
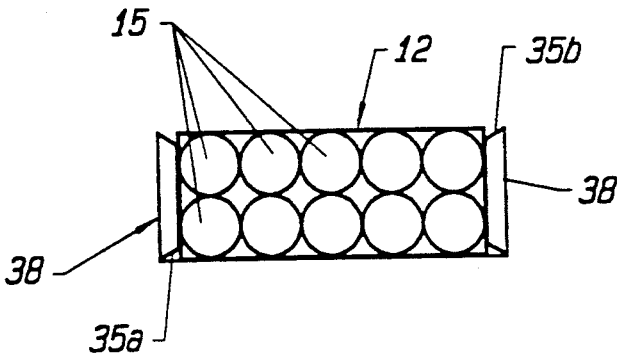
Figure 6A:
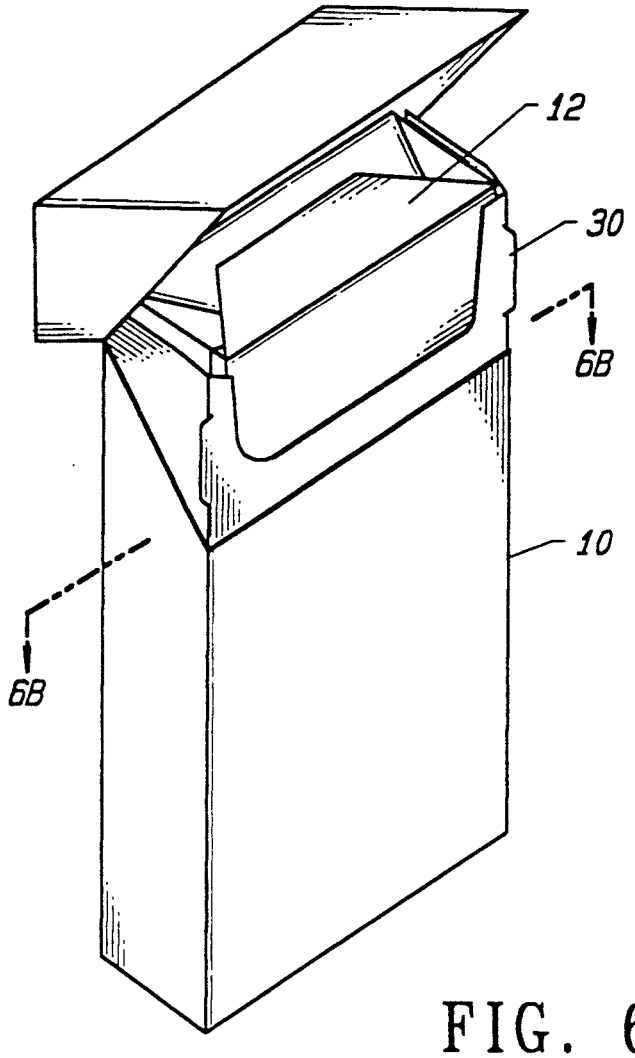
FIGS. 6A and 6B are perspective and plan views of the innerframe of the present invention utilized with an outer carton for packaging cigarettes.
Figure 6B:
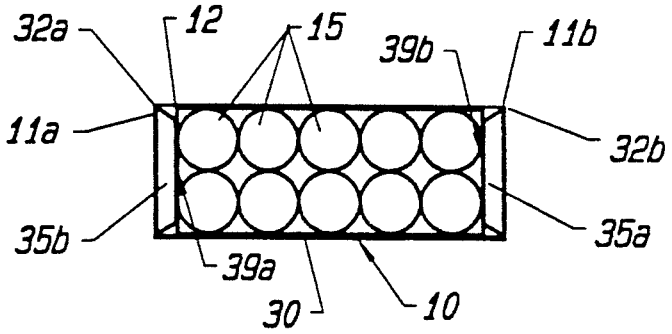

As shown specifically in FIGS. 5A and 5B, interior surfaces 39*a* and 39*b* of innerframe 30 biasing elements 35*a* and 35*b* provide the surface area necessary to transmit the biasing force to the cigarette foil bundle 12. Once innerframe 30 is formed around bundle 12, front portion 36, and left and right side walls 38*a–b* provide engagement with the interior of outer carton 10 as shown in FIGS. 6A–6B. As shown specifically in FIG. 6B, edges 31*a* and 32*a* of biasing elements 35*b* and 35*a*, respectively, engage the corners 11*a* and 11*b* of outer carton 10 to ensure biasing elements 35*a* and 35*b* maintain their arcuate shape. This arcuate shape of elements 35*a–b*, the engagement of biasing elements 35*a* in this manner, and the structural rigidity of the formable material provides the biasing force on foil wrapped cigarette bundle 12.

Figure 7B:
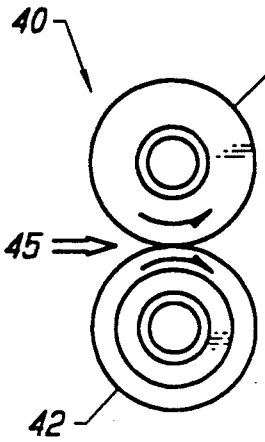
FIGS. 7A and 7B are plan views of the cutting mechanism for preparing an innerframe blank depicted in FIG. 2B.
Figure 7A:
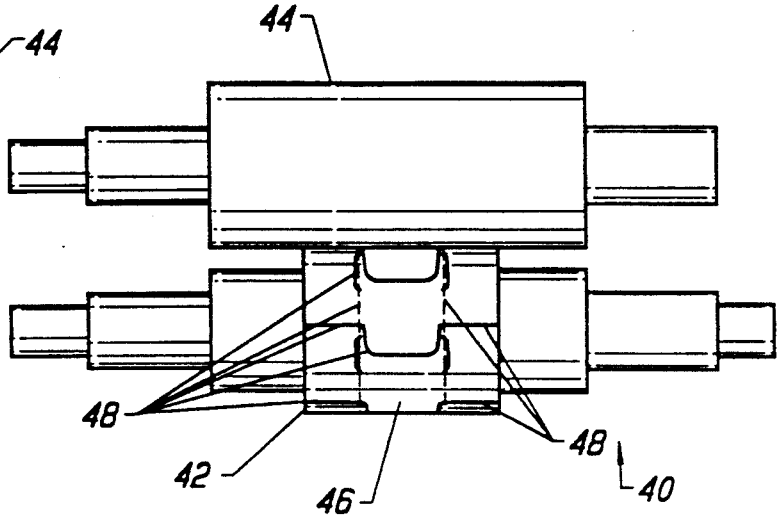
Figure 8B:
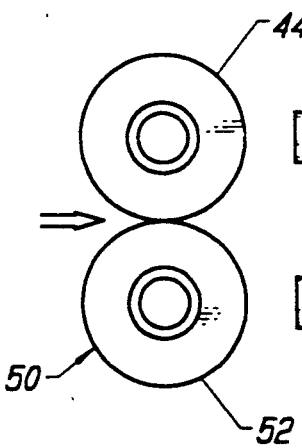
FIGS. 8A and 8B are plan views of the cutting mechanism for providing the innerframe of the present invention depicted in FIG. 4B.
Figure 8A:
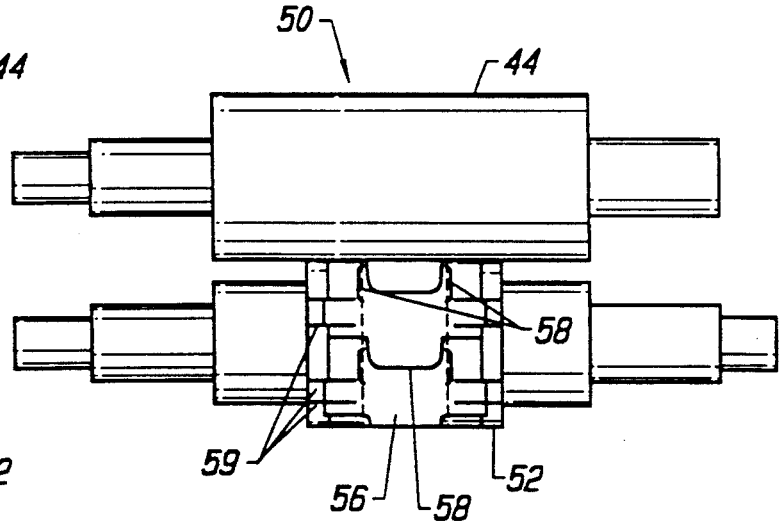

An apparatus for providing the improved innerframe is discussed with reference to FIGS. 7A–9C. FIGS. 7A and 7B show a conventional innerframe cutting apparatus 40. The apparatus includes a cutting roller 42 and a plane roller 44, between which a blank sheet of cardboard or other formable material having a width roughly equal to the cutting roller is passed to form innerframe blanks. Cutting mechanism 40 generally includes a single source drive motor coupled to a gear arrangement (not shown) to provide drive power which allows rollers 42 and 44 to synchronously rotate in opposite directions as shown in FIG. 7B. Rollers 42 and 44 are provided in engagement with each other with sufficient force such that when a sheet of formable material is passed therethrough in the direction of arrow 45, innerframe blanks with the desired perforations and cuts are yielded. Cutting roller 42 includes cutting die 46 which has raised portions 48 for providing the cuts and perforations in the formable material as the material is passed through rollers 42 and 44. Rollers 42 and 44 are preferably comprised of stainless steel, although any other durable hard metal will suffice.

The apparatus of FIGS. 7A and 7B produces the conventional innerframe blank 20 as shown in FIGS. 2A–2C.

An apparatus for forming the improved innerframe of the present invention is discussed with reference to FIGS. 8A–9C. Common reference numerals are used to refer to those elements of the improved cutting mechanism 50 in common with conventional innerframe cutting mechanism 40.

Improved innerframe cutting mechanism 50 includes a plane roller 44 and a cutting roller 52 for passing a formable material therethrough. Cutting roller 52 includes cutting die 56 having an improved blade configuration. Cutting die 56 includes blade portion 58 somewhat similar to that of conventional innerframe cutting mechanism 40, but with a different die structure which includes horizontal blades 59 to provide the biasing elements 35 in the innerframe of the present invention. Plane roller 44 may have a textured surface to ensure that the formable material is securely passed through mechanism 50.

In the conventional cutting apparatus 40 discussed with reference to FIGS. 7A and 7B, the width of the conventional innerframe is roughly equal the width from the edge side 18*a* to the edge side 18. As shown in FIG. 4B, the width W of the formable material passed through roller 44 and 52 in the improved cutting apparatus equals the width from side 31*a* to side 32*a* and is wider than a conventional innerframe blank for the same sized container. Consequently, cutting die 56 must be wider than cutting die 46 to form biasing elements 35*a–b* and to allow for excess material to be trimmed from the formable material. Furthermore, the conventional cutting apparatus 40 yields approximately seven (7) innerframe blanks per one 360° revolution of the cutting roller 42. Improved innerframe cutting apparatus yields only five (5) innerframe blanks per 360° revolution. This is due to the desire to provide for additional length (1') for innerframe 30 to provide for longer sidewalls 38*a–b* and greater material for providing biasing elements 35 to enhance the holding effectiveness of innerframe 30. It will, however, be recognized by those skilled in the art that any size or types of rollers may be used to generate any number of innerframe blanks per single revolution of cutting rollers. Furthermore, it will be recognized by those skilled in the art that a improved innerframe cutting roller die 56 may be substituted for a conventional innerframe cutter 46 to provide a modification of conventional machinery utilized in the art. Such a conversion requires modification of the gearing which drives the plane roller and the cutting roller to ensure synchronization between the two rollers. Such synchronization of gearing is well known to one skilled in the art.

Subsequent to the formation of improved innerframe blanks 39 by innerframe mechanism 50, improved innerframe blank 39 is passed through formation apparatus 60 to provide the arcuate shapes to biasing elements 35*a–b*. Formation apparatus 60 is discussed with reference to FIGS. 9A–9C.

Figure 9B:
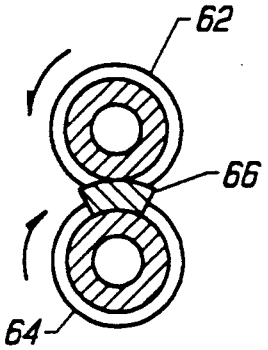
FIGS. 9A–9C are plan and perspective views of the formation roller of the present invention for use with the innerframe cutting apparatus of the present invention.
Figure 9A:
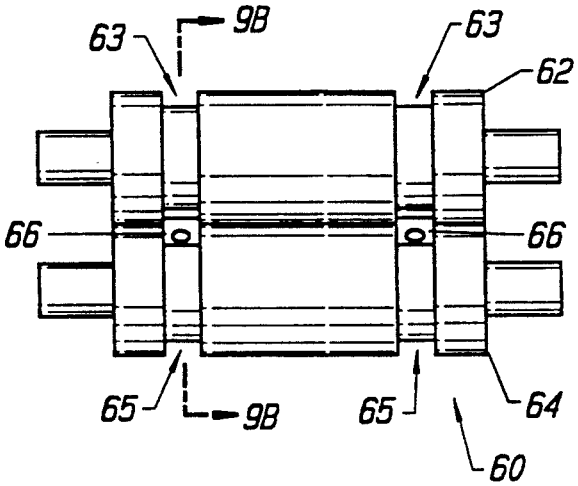
Figure 9C:
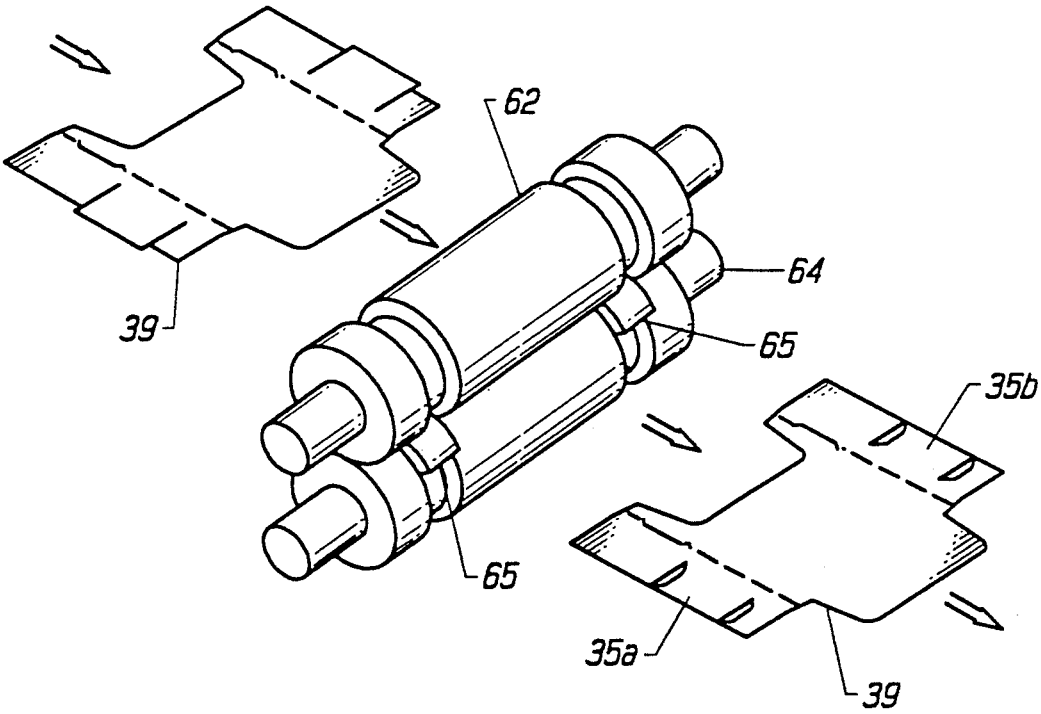

Formation apparatus 60 includes a first roller 62 and a second roller 64 which may be placed adjacent to the plane roller 44 and improved cutting roller 52 of the improved cutting apparatus 50 of the present invention. Roller 64 includes eccentric elements 66 mounted in grooves 65. Roller 62 includes grooves 63 which correspond in horizontal placement to grooves 65 in roller 64. Rollers 62 and 64 are caused to synchronously rotate in opposite directions such that when improved innerframe blank 39 is caused to pass between roller 62 and 64, as shown in FIG. 9C, biasing elements 35*a–b* are given their desired arcuate shape. In the preferred embodiment of the invention, rollers 62 and 64 are coupled to the same single drive power motor as plane roller 44 and cutting roller 52. Further in the preferred embodiment, rollers 62 and 64 are geared to be synchronized with rollers 44 and 52 to rotate one revolution for each 72° revolution of the rollers 52 and 44 such that one improved innerframe blank 30 passes through rollers 62 and 64 per revolution.

Figure 10B:
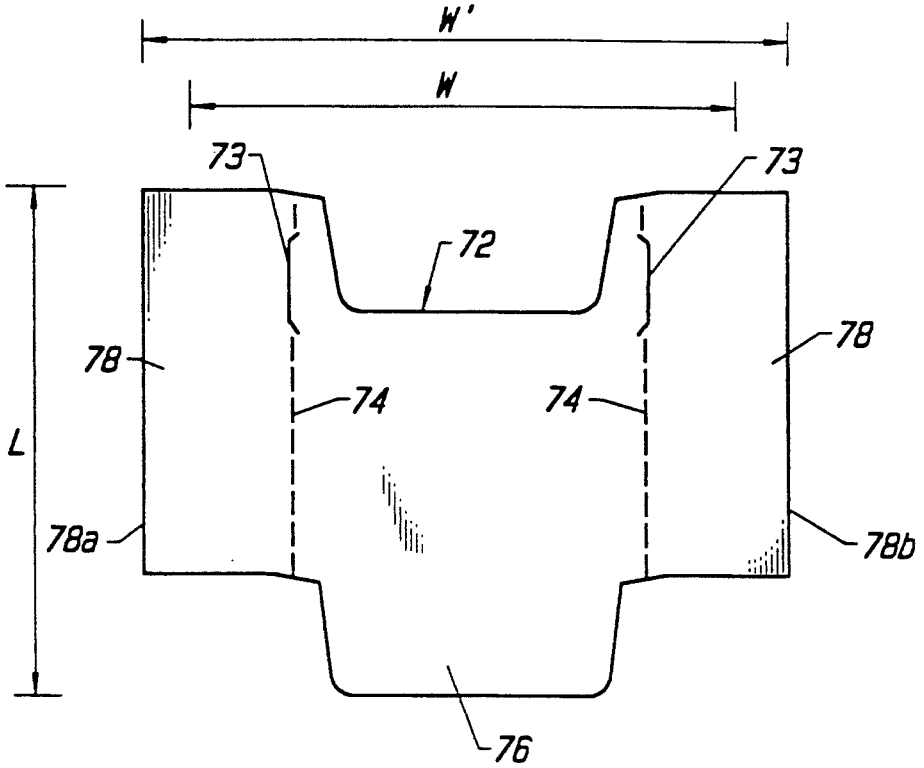
FIG. 10B is a plan view of the blank for making the innerframe of FIG. 10B.
Figure 10A:
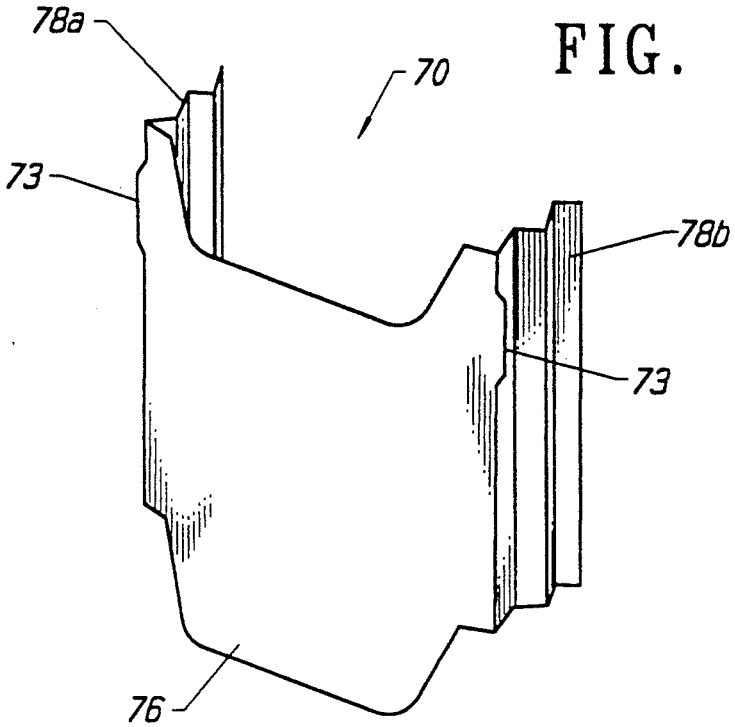
FIG. 10A is a perspective view of an embodiment of the innerframe of the invention.

FIGS. 10*a* and 10*b* shown an alternative embodiment of the approved innerframe of the present invention. Innerframe blank 72 includes perforation 74 and tab 73 forming a central region 76 and two side regions 78*a* and 78*b*. As shown in FIG. 10B, the width w" is wider than the width w of a conventional innerframe as shown in FIG. 2B. As shown in FIG. 10A, this allows side 78 to be crimped and edges 78*a* and 78*b* to provide engagement with the interior corners of outer carton 10. Alternative embodiment 70 of the improved innerframe of the present invention provides biasing force concentrated in two regions on each interior side of innerframe 70 as shown in FIG. 10A. It will be understood by those skilled in the art that any number folds in side 78 may be provided to provide varying degrees and surfaces of biasing force.

The many features and advantages of the improved innerframe and innerframe cutting apparatus of the present invention will be apparent to those skilled in the art from the specification and the claims. The innerframe described herein provides a secure structure for storing cigarettes or other rod-like structures within a particular outer container. Numerous variations are possible as will be apparent to those skilled in the art; such variations are intended to be within the scope of the invention as defined by this specification and the following claims are intended to cover all the modifications and equivalents falling within the scope of the invention.

What is claimed is:

1. A frame for insertion into a box container, the container having a bottom box panel a top lid box panel, opposing right and left side box panels and opposing front and back box panels, the frame for securely retaining a bundle of elongated members within the container, comprising:

a front frame panel portion defined by a left side and a right side, and a top and bottom margin;

a left side frame panel connected to said front frame panel along said left side of said front frame panel, said left side frame panel including a first, second and third free edges, said first free edge opposing said left side of said front frame panel at a distance D therefrom, and having a left side biasing portion formed therein, the biasing portion including a fourth, fifth and sixth free edges, said fourth free edge opposing said left side at a distance greater than D from said left side; and a right side frame panel connected to said front frame panel along said right side of said front frame panel, said right side frame panel including a first, second and third free edges, said first free edge opposing said right side of said front frame panel at said distance D therefrom, and having a right side biasing portion formed therein, the biasing portion including a fourth, fifth, and sixth free edges, said fourth free edge opposing said right side at a distance greater than D from said right side;

wherein the frame is erected and inserted into the box so that said front frame panel is contiguous with the front box panel, said left frame panel is contiguous with the left side box panel, and the right frame panel is contiguous with the right side box panel.

2. The frame of claim 1 wherein said left side box panel has a length and a width, said left side frame panel has a width, defined by said left side of said front frame panel and the opposing first free edge of the left side frame panel, which is approximately equal to the width of said left side box panel, and said left side biasing portion comprises an elongated region within said left side panel, wherein the fourth free edge of the left side biasing portion extends beyond said first free edge of said left side frame panel.

3. The frame of claim 2 wherein said left side biasing portion is formed with an arcuate shape such that said fourth free edge of said elongated region aligns with said first free edge of said left side panel.

4. The frame of claim 1 wherein said right side box panel has a length and a width, said right side frame panel has a width, defined by said right side of said front frame panel and the opposing first free edge of the right side frame panel, which is approximately equal to the width of said right side box panel, and said right side biasing portion comprises an elongated region within said right side panel, wherein the fourth free edge of the right side biasing portion extends beyond said first free edge of said right side frame panel.

5. The frame of claim 4 wherein said right side biasing portion is formed with an arcuate shape such that said fourth free edge of said elongated region aligns with said first free edge of said right side panel.

6. An innerframe for insertion into a cigarette box for securely retaining a bundle of cigarettes within the cigarette box, the innerframe comprising:

a front frame panel having a width sufficient to be accommodated within the cigarette box and having first and second sides;

a first sideframe panel connected to the first side of the front frame panel and having a first free edge at a first distance from the first side, said first sideframe panel having an elongated biasing portion formed therein, the biasing portion including a second free edge opposing the first side at a second distance greater than the first distance and formed with an arcuate shape such that said second free edge aligns with the first free edge; and a second sideframe panel connected to the second side of the front frame panel and having a third free edge at the first distance from the second side, said second sideframe panel having an elongated biasing portion formed therein, the biasing portion including a fourth free edge opposing the third side at said second distance and formed with an arcuate shape such that said fourth free edge aligns with the third free edge;

wherein a portion of the respective elongated biasing portions of said first and second sides engage at least a portion of the bundle of cigarettes to exert a force upon the bundle of cigarettes so as to secure the bundle of cigarettes in the cigarette box.

7. The frame of claim 6 wherein said cigarette box includes a first side box panel having a length and a width, said first sideframe panel has a width defined by said first side of said front frame panel and the first free edge which is approximately equal to the width of said first side box panel.

8. The frame of claim 6 wherein said cigarette box includes a second side box panel having a length and a width, said second sideframe panel has a width defined by said second side of said front frame panel and the third free edge which is approximately equal to the width of said second side box panel.

9. A blank forming an innerframe inserted in a cigarette box, comprising:

a front panel portion defined by a pair of parallel first and second side score lines, and top and bottom front panel margins;

a first outer side panel portion, substantially planar and rectangular in shape, connected to the front panel portion along the first side score line and having a first outer edge opposite said score line defining the width of the first outer side panel portion;

a first elongated biasing portion having a substantially rectangular planar shape, wherein one side of the first biasing portion would extend beyond the first outer edge when planar, said first biasing portion being formed into a substantially arcuate shape wherein said one side of the first biasing portion aligns with the first outer edge;

a second outer side panel portion, substantially planar and rectangular in shape connected to the front portion along the second side score line and having a second outer edge opposite said score line defining the width of the first outer side panel portion; and a second elongated biasing portion having a substantially rectangular planar shape wherein one side of the second biasing portion would extend beyond the second outer edge when planar, said second biasing portion being formed into a substantially arcuate shape when said one side of the second biasing portion aligns with the second outer edge.

10. A blank for forming an innerframe for insertion into a cigarette box for securely regaining a bundle of cigarettes within the cigarette box, comprising:

a planar sheet of pliable material having a having an edge portion and having formed therein a first perforated line and a second perforated line, said first and second perforated lines being parallel to each other and forming a first, second, and third regions on said sheet, and a first, second, and third subregions within said first region, and a fourth, fifth, and sixth subregion within said third region, said subregions being formed by first and second parallel cuts in said first region, and third and fourth parallel cuts in said third region, each of said parallel cuts being perpendicular to said perforated lines;

wherein each said subregion has a first end and a second end, said first end of each said subregion being defined by said perforated line, and said second end of said subregion being defined by said edge of said pliable material, the distance between said first and second ends of said second subregion is greater than that of said first and third subregions, and the distance between said first and second ends of said fifth subregion is greater than that of said fourth and sixth subregions.

11. A frame for insertion into a box container, the container having a bottom box panel a top lid box panel, opposing right and left side box panels and opposing front and back box panels, each panel having a length and a width, the frame for securely retaining a bundle of elongated members within the container, comprising:

a front frame panel portion defined by a left side and a right side, and a top and bottom margin;

a left side frame panel connected to said front frame panel along said left side of said front frame panel, said left side frame panel having a length and a width, the width being greater than said width of said left side box panel; and a right side frame panel connected to said front frame panel along said right side of said front frame panel, said right side frame panel having a length and a width, the width being greater than the width of said right side box panel;

wherein the frame is erected and inserted into the box so that said front frame panel is contiguous with the front box panel, said left frame panel is contiguous with the left side box panel, and the right frame panel is contiguous with the right side box panel, and said left and right side frame panels are crimped in at least two regions to form first and second creases in each side frame panel so that each crease is parallel to an edge formed by the intersection of the respective side frame panels and the front frame panel.

* * * * *

UNITED STATES PATENT AND TRADEMARK OFFICE

CERTIFICATE OF CORRECTION

PATENT NO. : 5,314,062

DATED : May 24, 1994

INVENTOR(S) : Wu, et al.

It is certified that error appears in the above-identified patent and that said Letters Patent is hereby corrected as shown below:

ON THE TITLE PAGE
Insert --Assignee: P.T.H.M. Sampoerna, Indonesia --.

Page 1, line 16: "fame" should be "frame"

Col. 2, line 18: "fame" should be "frame"

Col. 5, line 6: "shown" should be "show"

Col. 5, line 37: after "a bottom box panel" insert a comma

Col. 7, line 35: "regaining" should be "retaining"

Col. 7, line 37: after "material" delete "having a"

Col. 8, line 16: after "a bottom box panel" insert a comma

Signed and Sealed this

Eleventh Day of April, 1995

*Attest:*

Bruce Lehman

BRUCE LEHMAN

*Attesting Officer*

*Commissioner of Patents and Trademarks*